US006179981B1

(12) United States Patent
Masson et al.

(10) Patent No.: US 6,179,981 B1
(45) Date of Patent: Jan. 30, 2001

(54) METHOD FOR SEPARATING TECHNETIUM FROM A NITRIC SOLUTION

(75) Inventors: Michel Masson; Michaël Lecomte, both of Avignon (FR); Alexandre Masslennikov; Vladimir Peretroukhine, both of Moscow (RU)

(73) Assignees: Commissariat a l'Energie Atomique, Paris; Compagnie Generale des Matieres Nucleaires, Velizy-Villacoublay, both of (FR)

( * ) Notice: Under 35 U.S.C. 154(b), the term of this patent shall be extended for 0 days.

(21) Appl. No.: 09/254,210

(22) PCT Filed: Jul. 3, 1998

(86) PCT No.: PCT/FR98/01425

§ 371 Date: Jun. 7, 1999

§ 102(e) Date: Jun. 7, 1999

(87) PCT Pub. No.: WO99/01591

PCT Pub. Date: Jan. 14, 1999

(30) Foreign Application Priority Data

Jul. 4, 1997 (FR) ..... 97 08524

(51) Int. Cl.[7] ..... C25C 1/00
(52) U.S. Cl. ..... 205/43; 205/560
(58) Field of Search ..... 588/204; 205/560, 205/43

(56) References Cited

U.S. PATENT DOCUMENTS 3,374,157 3/1968 Box ..... 204/45
3,890,244 * 6/1975 Carlin ..... 205/560 X
3,922,231 11/1975 Carlin et al. ..... 252/301.1
3,932,225 * 1/1976 Bilal et al. ..... 205/43 X
5,536,389 * 7/1996 La Naour et al. ..... 588/204 X
5,894,077 * 4/1999 Jones et al. ..... 205/560 X

OTHER PUBLICATIONS

R.E. Voltz et al., "Electrodeposition of $Tc^{99}$ from Aqueous Solutions", *Journal of the Electrochemical Society,* vol. 114, No. 2, pp. 128–131 (1967) (No Month).

J.P. Rileyet al., The Determination of Technetium–99 in Seawater and Marine Algae, *Anal. Chim. Acta* (1982) 139, pp. 167–176 [*Chemical Abstracts,* vol. 97, No. 16] (No Month).

B.G. Brodda et al., "Process Chemistry of Technetium in the Feed Adjustment Step of Fuel Reprocessing", *Radiochimica Acta,* vol. 37, pp. 213–216 (1984) No Month.

* cited by examiner

*Primary Examiner*—Donald R. Valentine
(74) *Attorney, Agent, or Firm*—Anderson, Kill & Olick P.C.

(57) ABSTRACT

The present invention relates to a process for separating technetium from a nitric solution of technetium through cathodic electrodeposition of said technetium by electrolysis. According to the process of the invention, the nitric solution of technetium is denitrified and its pH is adjusted to a value of approximately 5.5 to 7.5 before electrolysis. Electrolysis is conducted at galvanostatic rate, and the cathode potential is approximately −1.36 V/SHE to −1.16/SHE. The ratio of the cathode surface area (S) to the volume of the technetium solution to be electrolyzed may be in the region of 0.25 to 0.50 $cm^{-1}$.

15 Claims, 1 Drawing Sheet

METHOD FOR SEPARATING TECHNETIUM FROM A NITRIC SOLUTION

FIELD OF THE INVENTION

Figure 1:
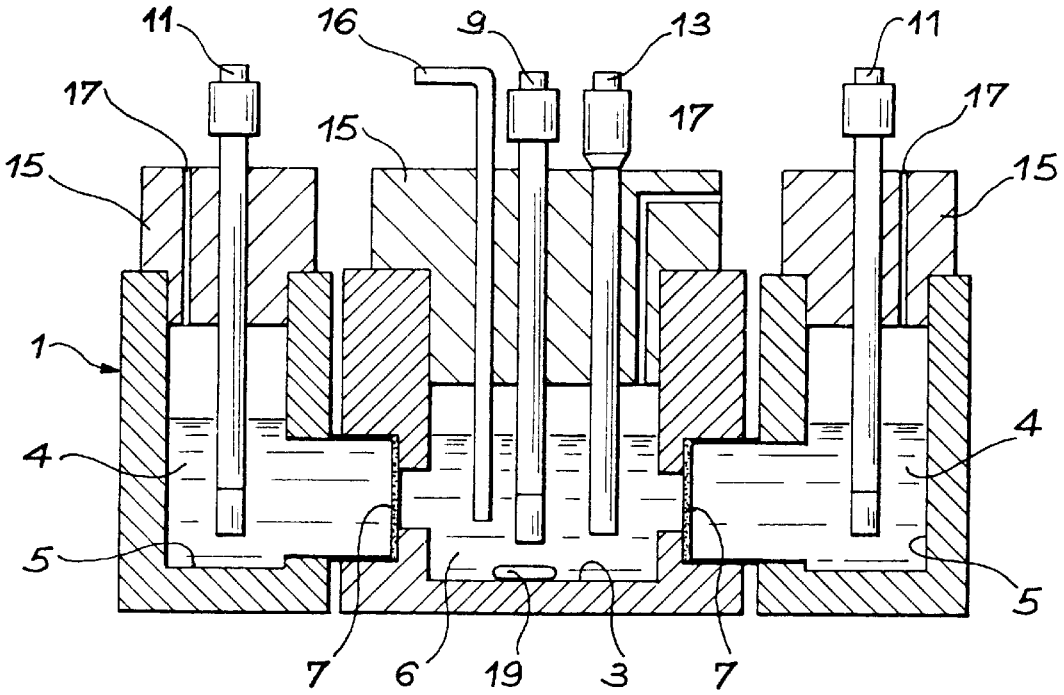

The present invention relates to a process for separating technetium from a nitric solution of technetium through electrolysis.

More particularly, the invention relates to the separation of Technetium-99 having the chemical formula $TcO_4$—, also called Tc(VII), or pertechnetate, from a nitric solution through electrodeposition of metal technetium, corresponding to Tc(0) also called $Tc_{met}$, and of $TcO_2$, $H_2O$, corresponding to Tc(IV).

Nitric solutions of technetium are for example solutions derived from the reprocessing of irradiated nuclear fuel, and more generally from the processing of radioactive waste. Also, with the process of the invention, it is possible to reduce the β activity of these nitric solutions.

This process of separation may be followed by a vitrifying process to stock the technetium extracted from these solutions.

The process of the invention finds application for example in the separation of technetium-99, from solutions derived from the counter-flow liquid-liquid "PUREX" extraction process for reprocessing irradiated nuclear fuel. This process uses a solution of concentrated nitric acid as extraction solution, and the technetium-99 collecting in this solution may reach concentrations of 150 to 200 mg/l, for nitric concentrations which may be as high as 3.5 to 4.5 mol/l. This extraction solution may also, in trace form, contain other elements derived from nuclear combustion such as $^{106}Ru$, $^{134}Cs$, $^{137}Cs$, $^{144}Ce$, $^{154}Eui$, $^{125}Sb$.

Table 1 below shows one example of the analysis results of the different chemical species present in an extraction solution of the "PUREX" process.

TABLE I

Analysis of a nitric solution derived from a "PUREX" process

| Component | Unit | Value |
|---|---|---|
| $HNO_3$ | mol/l | 3.5–4.5 |
| Technetium (VII) | mg/l | 150–200 |
| Ruthenium-106 | μCi/l | 50 |
| Antimony-125 | μCi/l | 2.5 |
| Caesium-134* | μCi/l | 40 |
| Caesium-137 | μCi/l | 50 |
| Cerium-144 | μCi/l | 40 |
| Europium-154 | μCi/l | 5 |

The technetium contained in these solutions cannot be collected by an evaporation process of the aqueous phase since such process would lead to loss of the most of the technetium in the form of volatile Technetium-99 in solution, through its ionic structure, has the properties of an electrolyte, that is to say that under the effect of an electric field in an electrolytic cell, it will migrate towards the cathode on which it will be reduced. The chemical reaction equations (1) and (2) below illustrate an electrolysis of an aqueous solution of technetium-99 or $TcO_4^-$:

$$TcO_4^- + 8H^+ + 4e^- \rightarrow Tc^{3+} + 4H_2O \quad Tc^{3+} + 3e^- \rightarrow Tc_{met} \tag{1}$$

$$TcO_4^- + 8H^+ + 3e^{31} \rightarrow Tc^{4+} + 4H_2O \quad Tc^{4+} + 40H^-_{cathodic} \rightarrow Tc_2,\ 2H_2O \tag{2}$$

These equations (1) and (2) show that, in theory, a deposit of a mixture forms on the cathode, or a mixed deposit of metal Tc represented as $Tc_{met}$ in equation (I), and of $TcO_2$, $2H_2O$ according to equation (2).

Two types of yield may be calculated to assess this electrolysis:

- a chemical electrolysis yield defined as the ratio between the quantity in mg of technetium $Tc_{met}$ and/or $TcO_2$, $2H_2O$, deposited on the cathode, and the quantity in mg of technetium-99 present in the solution before electrolysis;
- a faradic electrolysis yield defined as the ratio between the number of coulombs passed through the electrolytic cell and the quantity of Tc deposited on the cathode surface.

The two preceding reaction equations (1) and (2) show that the quantity of $Tc_{met}$ and $TcO_2$, $2H_2O$ deposited on the cathode, and therefore the chemical electrolysis yield, relates firstly to the technetium concentration at the start of electrolysis and, secondly, to the pH of the aqueous solution of technetium. When the technetium concentration increases, the chemical and faradic yields of metal Tc increase, and when the pH increases the chemical and faradic yields of $Tc_{met}$ are reduced.

The technetium concentration and pH of the electrolyte solution also have an influence on the stability of the chemical forms of technetium with reduced (II) and (IV) valences in respect of the hydrolysis reaction. Any variation in the Tc concentration of the solution does not alter the chemical and faradic yields of electrodeposition. On the other hand, when the pH of the solution increases, the hydrolysed chemical forms Tc (III, IV), including TcO(OH) and $TcO(OH)_2$, increase in concentration leading to a reduction in the chemical yield of the process.

Also, in respect of pH, it has been shown that when the H+ ion concentration of the electrolysis solution is higher than 0.1 M, that is to say when the pH of this solution is less than 1, the electrodeposition of $TcO_2$, $2H_2O$ is greatly reduced owing to its extensive solubility in an acid medium.

Also, the electrodeposition of metal Tc in an aqueous solution on the cathode modifies the electrochemical properties of the latter, in particular it may cause a reduction in the hydrogen overvoltage, that is to say an increase in the rate of electrochemical decomposition of the water molecules, leading to a rise in the pH of the solution.

Hydrogen overvoltage being defined as the difference between the thermodynamic value of the potential of the $H^+/H_2(E=O)$ couple and the value of the potential over and above which the formation of hydrogen is effective is a real system. The hydrogen overvoltage value characterises the rate of electrochemical decomposition of water during the electrolysis of aqueous solutions.

A decrease in the hydrogen overvoltage, that is to say an acceleration in the electrochemical decomposition of water, can be seen during electrolysis accompanied by the formation of the cathode deposit of a metal.

Such electrochemical modification may cause a fast hydrolysis reaction of the electrodeposited species.

PRIOR ART

Document U.S. Pat. No. 3,374,157 describes a process for the electrodeposition of metal technetium on a metal substrate to prepare a source of technetium-99.

Electrodeposition of metal technetium is conducted using 150 ml of a sulphuric acid solution containing technetium-99 in the form of ammonium pertechnetate, and a completing agent stabilizing the pertechnetate ions. The complexing agents described are oxalic acid, citric acid, tartaric acid, glutaric acid, malonic acid, succinic acid and their ammonium salts. These complexing agents are intended to increase the chemical yield of metal Tc formation. The pH of this solution lies between 1 and 2 and the metal technetium is electrodeposited on a metal substrate such as copper, nickel, aluminium, silver, gold, stainless steel and platinum.

One of the drawbacks of this process is that the complexing agent stabilzing the pertechnetate ions slows down the rate of hydrolysis of the Tc(III) and Tc (IV) ions and at the same time moves the electrodeposition potential of the technetium towards negative values thereby causing a drop in the faradic yield of the technetium and an increase in $TcO_2$, $2H_2O$ in the deposit on the metal substrate.

Further, this document describes a quantitative electrodeposition of metal Tc on a metal substrate, but does not describe the separation of technetium-99 from a nitric solution.

In a nitric solution, the presence of nitrate ions complicates the electrochemical reduction mechanism of technetium-99.

The reaction equations (3), (4), (5) and (6) below illustrate the different possible electrochemical reactions during the electrolysis of an electrolyte solution containing technetium-99 in the presence of nitrate ions:

$$NO_3^- + 3H^+ + 2e^- \rightarrow HNO_2 + H_2O \quad (3)$$

$$Tc(III) + NO_2^- + 2H^+ \rightarrow Tc(IV) + NO + H_2O \quad (4)$$

$$Tc(IV) + NO_2^- + 2H^+ \rightarrow Tc(V) + NO + H_2O \quad (5)$$

$$Tc(III) + NO_3^- + 2H^+ \rightarrow Tc(VII) + NO_2^- + H_2O \quad (6)$$

The reaction equation (3) illustrates a cathodic reduction of the nitrate ions in nitrous acid $HNO_2$ at the time of electrolysis.

Reaction equations (4) and (5) illustrate an oxidation of the Tc(II) and Tc(IV) ions by nitrous acid with the formation of Tc(IV) and Tc(V) ions respectively.

Reaction equation (6) illustrates a slow reaction between the Tc(III) ions and the $NO_3^-$ ions leading to an additional formation of nitrous acid in the electrolysis solution.

The increase in the nitrous acid concentration during electrolysis facilitates the occurrence of reactions (4) to (6) and increases the solubility of $TcO_2$, $2H_2O$, that is to say of Tc(IV), and the formation of hydrogen.

Also, the chemical reactions illustrated by reaction equations (3) to (6) show a decrease in the pH of the electrolysis solution. This drop in pH leads to the hydrolysis of the Tc(III) and Tc(IV) ions and the formation of electrochemically inactive species, such as $TcO(OH)_2$, $(TcO(OH)_2)_2$ or TcO(OH), causing a drop in the electrodeposition yield of technetium.

The document by B. G. Brodda, H. Lammertz, E. Merz-Radiochemica Acta, 1984 v.37, pp.213 to 216 describes an electrolytic reduction test of technetium-99 in a 0.1 M nitric medium. The electrolysis solution used contains $7\times10^{-3}$ M Tc(VII). The electrolytic cell comprises a platinum anode and a zirconium cathode. The current density used is 40 $A/m^2$. A black amorphous precipitate identified as $TcO_2$, $H_2O$ was formed on the cathode. This document forms the preamble for claim 1 of the present invention.

DISCLOSURE OF THE INVENTION

The purpose of the present invention is precisely to provide a method for separating techentium-99 from a nitric solution of technetium consisting of submitting the nitric solution to electrolysis to electrodeposit the technetium on a cathode, said process also comprising the following stages:

removal of the nitrates from the nitric solution of technetium to obtain a solution a) of technetium comprising little or no nitrates, adjusting the pH of technetium solution a) to a pH of approximately 5.5 to 7.5 to obtain a solution b) of technetium, and separating the technetium from solution b) through cathodic electrodeposition of said technetium by electrolysis.

The nitric solution of techentium-99 may for example have a nitrate concentration of approximately 3.5 to 4.5 mol/l and a technetium concentration of 150 to 200 mg/l. This solution may, for example, be derived from the reprocessing of irradiated nuclear fuel using the "PUREX" process.

The removal of the nitrates from the nitric solution of technetium, hereinafter called denitration, may be conducted with formic acid or formaldehyde in the presence of a catalyst.

This removal may be conducted using formaldehyde, oxalic acid, methanol, sugar etc. and in general with organic compounds containing one or more of the groups chosen from the group comprising —OH, —COH and/or —COOH, possibly in the presence of a catalyst.

The catalyst used may be a catalyst comprising platinum, for example a 1% $Pt/SiO_2$ catalyst.

During denitration, the technetium remains at valence (VII), the rate of the reaction of the technetium on formic acid being very slow, and the technetium ions with lowered valences which appear in the solution are reoxidized by the nitrous acid which is an intermediate product of denitration.

One example of denitration of a solution with formic acid is described for example in document A.V. Ananiev, NRC4, $4^{th}$ International Conference on Nuclear and Radiochemistry, vol. II, St. Malo, France, Sept. 96. In this document denitration is conducted in thermostat-controlled glass reactor with a reflux. One portion of 1% $Pt/SiO_2$ catalyst (weight %) is poured into this reactor with the nitric solution to be denitrified, the concentration of this nitric solution being known. Concentrated formic acid is then added to the reactor in stoichiometric quantity, or higher, to the quantity of nitrates present in the solution to be denitrified. The nitric solution, catalyst and formic acid mixture is subjected to nitrogen bubble stirring and brought to a temperature of approximately 60 to 80° C. for approximately 90 minutes. A solution is obtained in which the nitrates cannot be detected by potentiometry, that is to say their concentration is less than $10^{-4}$ mol/l.

According to the process of the invention, the formic acid is preferably added in excess in relation to the nitrate ions of the nitric solution of technetium. The removal of the nitrates from this nitric solution is then followed by adjustment of the excess formic acid before the adjustment of the pH, consisting of removing this excess for example by evaporation of the formic acid.

In this way a technetium solution is obtained called solution a) which is virtually free of nitrates.

Denitration of the nitric solution of technetium-99 provides a low, stationary concentration of nitrous acid during electrolysis.

The foregoing solution a) is then submitted to adjustment of its pH to a pH of approximately 5.5 to 7.5, preferably a pH of approximately 6 to 7.4, to obtain a solution b) of technetium. This adjustment is conducted using a reagent chosen in relation to the restraints connected with the process downstream from technetium separation for its storage.

For example, the application of alkaline metal hydroxides for pH adjustment is not possible if the technetium separation process is to be followed by a vitrifying process as their presence in the waste disturbs vitrification.

According to the process of the invention, this adjustment is preferably conducted using the base $(CH_3)_4NOH$. This $(CH_3)_4NOH$ base (tetramethylammonium) was chosen since the compounds of technetium-99 coupled with tetraalkylammonium cations with longer (—$CH_2$—) chains have insufficient solubility in aqueous solutions.

Preferably, the reagent for pH adjustment is used in solid form to avoid an increase in solution volume.

The pH adjustment of the technetium solution, according to the process of the invention, appeared to be essential as the electrodeposition yield of technetium proved to be highly sensitive to this parameter, and the best yields were obtained in solutions with a pH of approximately 5.5 to 7.5. Also, little or no electrodeposition of technetium was observed during electrolysis of a formiate solution with a pH of less than 2.

Further, the pH adjustment of the solution led to reducing the solubility of $TcO_2,2H_2O$ electrodeposited during electrolysis and therefore to increasing the electrodeposition yield of technetium.

With the process of the invention it was possible to show that the formiate ions from the denitration of the nitric solution of technetium stabilize the Tc(III) and Tc(IV) complexes, and that the tetramethylammonium ions used to adjust the pH of the denitrified solution increase the solubility of these complexes in an aqueous solution.

Denitration and pH adjustment, in accordance with the process of the invention, may lead to the formation of a tetramethylammonium formiate solution containing the technetium to be separated. In this case, the tetramethylammonium formiate concentration guaranteeing an excess of complexing ions in relation to the technetium in order to avoid hydrolysis of Tc(III) and Tc(IV) is preferably 1 M.

The following stage is the separation stage of the technetium from solution b) through cathodic electrodeposition of said technetium by electrolysis of said solution b) in an electrolytic cell.

According to the process of the invention, the electrolytic cell comprises at least one anode compartment and at least one cathode compartment.

According to the process of the invention, solution b) of technetium is placed in the cathode compartment of the electrolytic cell, and in the anode compartment of this electrolytic cell a solution is added that is compatible for electrolysis.

The compatible solution for electrolysis may for example be a solution of $HClO_4$, $H_2SO_4$ or a solution of nitric acid, preferably a solution of nitric acid. Nitric acid was chosen to simplify the reprocessing of waste derived from the process of the present invention.

The anode and cathode compartments are preferably separated by a membrane impregnated with a cation exchanger in order to avoid the flow of technetium ions with valences (III) and (IV) from the cathode compartment(s) towards the anode compartment(s), and of $HCOO^-$ions from the anode compartment(s) towards the cathode compartment (s), followed by their reoxidation into Tc(VII) and $CO_2$ respectively. Indeed such reoxidation would lead to a marked decrease in the chemical yield of the electrodeposition of technetium.

The membrane impregnated with a cation exchanger may be any membrane of . . . type having cation exchanger properties, preferably the membrane used is a "Nafion 417" (registered trademark) membrane. This membrane was chosen in accordance with a study into the electrical and mechanical characteristics of different membranes described in document Aldrichimica Acta 1986, vol. 19, p.76.

The cation exchanger membrane also allows a stationary flow of $H^+$ ions to be created from the anode compartment(s) towards the cathode compartment(s) thereby maintaining the constant acidity of the solution in the cathode compartment.

Also, owing to the separation of the anode and cathode compartments b a cation exchanger membrane, the compatible solution contained in the anode compartment(s) may be used, without being changed, for ten to fifteen consecutive electrodeposition tests.

The anode and cathode compartments of the electrolytic cell comprise at least one anode and at least one cathode respectively.

The anode may be made in platinum or graphite. Preferably, the anode is a platinum anode. If the anode is in graphite, for an electrolysis time of more than 1 hour, the drop in potential on the interface between the graphite and the compatible 1 M $HNO_3$ solution must not exceed 600 mV. Should this drop in potential exceed 600 mV, mechanical degradation of the anode may be observed through the formation of fine graphite powder contaminating the anode compartment.

The cathode may be in graphite, graphite having two important electrochemical characteristics:

- the first characteristic is that the hydrogen overvoltage on a graphite electrode is high, that is to say in the region of −560 mV/SHE, allowing high faradic Tc yields to be obtained,
- the second characteristic is the large specific surface area of graphite. The electrodeposition of $Tc_{met}$ and/or $TcO_2$, $2H_2O$ on the cathode modifies the surface area of the latter, leading to a problem of decrease in hydrogen overvoltage. With graphite it is possible to remedy this problem and to maintain constant hydrogen overvoltage.

The choice of a graphite cathode having a large specific surface area therefore allows high faradic electrodeposition yields to be maintained for a longer time period and consequently to avoid the hydrolysis of Tc to lower valences in the precathode layer. The precathode layer being the layer in which the electrochemical reactions take place, that is to say the transfer of electrons from the cathode to the species which are reduced in the aqueous phase.

According to the process of the invention, the ratio of the surface area S of the cathode over volume V of the electrolysis solution in the cathode compartment may be less than 0.5 $cm^{-1}$, preferably from 0.2 to 0.5 cm−1, further preferably from 0.25 to 0.49 $cm^{-1}$. When this S.V ratio decreases, the faradic chemical yield and the rate of electrodeposition also decrease.

This S/V ratio may be greater than 0.5 $cm^{-1}$, and the increase in this ratio may increase the efficiency of technetium electrodeposition.

According to the process of the invention, the electrolytic cell may also comprise a standard electrode to measure the potential of the anode and/or cathode. This standard electrode is preferably a hydrogen electrode also called SHE. With this electrode placed for example in the cathode compartment, it is possible to measure the potential of the cathode during electrolysis.

Electrolysis of solution b) is conducted by the passing of a direct current between the anode and the cathode. The passing of a continuous current leads to the electrodeposition of technetium in the form of $Tc_{met}$ and/or $TcO_2$, $2H_2O$ according to the chemical reaction equations (1) and (2) previously described.

According to the process of the invention, the cathode potential is maintained constant throughout electrolysis, preferably between 0.56 V to −1.36 V in relation to SHE. A constant cathode potential during electrolysis allows the electrodeposition process to be conducted at galvanostatic rate. Using a cathode potential of −0.56 V/SHE to −1.36 V/SHE increases the chemical yield of technetium electrodeposition and accelerates technetium electrodeposition. A reduction in cathode potential to values lower than approximately −1.36 V/SHE does not increase the technetium electrodeposition yield.

According to the invention, the cathode potential range of −1.16 to −1.36 V/SHE corresponding to current densities of 30 to 50 $A/cm^2$ respectively, gives a chemical yield of technetium electrodeposition that is greater than 95%.

With the process of the invention, it is possible to obtain a chemical yield of technetium electrodeposition that is greater than 95% for an electrolysis time of two hours using a nitric solution containing 4.2 mol/l of $HNO_3$ and 220 mg/l of technetium.

The technetium is electrodeposited in the form of $Tc_{mrt}$ and/or $TcO_2$, $2H_2O$ on the cathode, and may be collected for example by immersing the cathode in a boiling hydrogen peroxide solution.

In the text of the present patent, the lowered valences of Tc are the oxidation sates +III and +IV. These valences are little stable in aqueous solutions. Their chemical state in solution has been little investigated. It is assumed that in a neutral medium, that is to say at a pH of between 5.0 and 8.0, the following species of Tc(IV) may co-exist.: $TCO(OH)^+$, $TcO(OH)_2$ and the polymerized hydroxide $(TcO(OH)_2)_2$. The concentration of the different chemical forms is defined by the total Tc concentration of and pH value. The addition to this system of complexing ions, for example formiate ions, leads to more complex hydrolysis reaction mechanisms. Exact data on the composition of Tc(IV, III) ions in an aqueous solution in the presence of formiate ions are not to be found in the technical and scientific literature.

Figure 2:
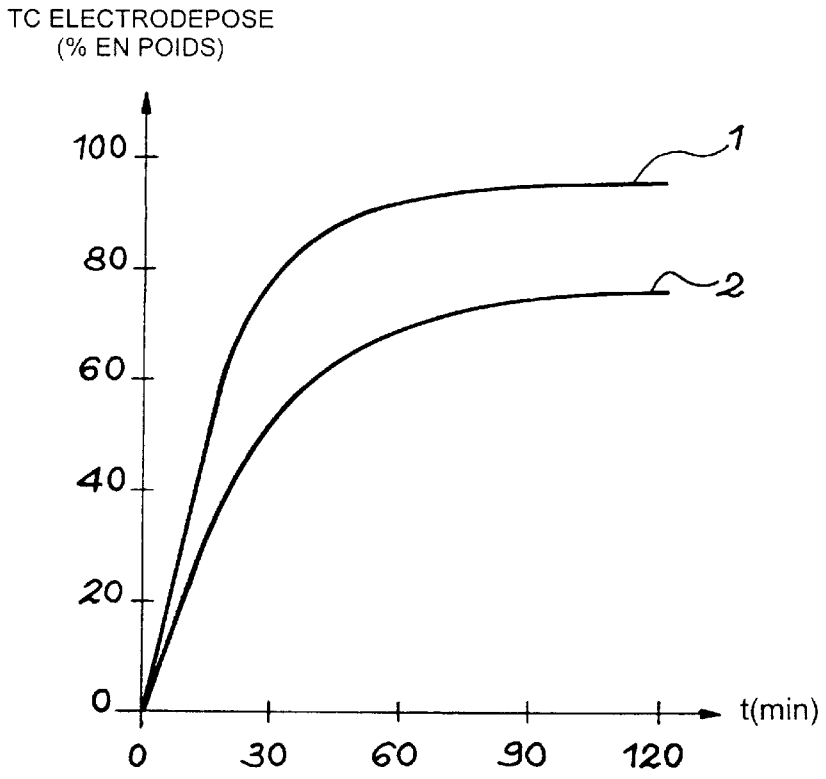

Other characteristics and advantages of the invention will be more clearly seen on reading the following examples which are given for illustration purposes and are non-restrictive, with reference to the appended drawings in which:

FIG. 1 is a diagram of an electrolytic cell for the electrodeposition of technetium according to the process of the invention, FIG. 2 shows the electrodeposition kinetics of technetium in relation to the cathode potential, expressed as a weight percentage of technetium electrodeposited on the cathode in relation to electrolysis time in minutes for two different S/V ratios, S being the surface area of the electrolytic cell cathode in $cm^{-1}$ and V being the volume of the electrolyte solution in the cathode compartment in $cm^3$.

EXAMPLE 1

Separation of Technetium from a Nitric Solution of Technetium Derived from a "PUREX" Extraction Process This example uses a nitric solution of technetium containing 4.2 mol/l of $HNO_3$ and 220 mg/l of technetium-99 or Tc(VII).

a) Denitration stage 10 ml of this nitric solution are treated with pure formic acid HCOOH in a concentration ratio of $[HCOOH]/[HNO_3]=1.5$ in the presence of a 1% $Pt/SiO_2$ platinum catalyst.

The 1% Pt/SiO2 catalyst is prepared by soaking silica gel in a solution of $H_2PtCl_6$ followed by the reduction of the platinum with hydrazine.

Denitration is conducted in a thermostat-controlled glass reactor with a reflux. The 1% $Pt/SiO_2$ catalyst is poured into the reactor with the nitric solution to a solid (catalyst)/liquid (nitric solution) volume ratio of 0.125.

The concentrated formic acid is then added to the reactor and the reactor contents are mixed by means of gaseous nitrogen bubbles at a temperature of 70° C. for approximately 90 minutes to obtain solution a).

Potentiometric analysis of solution a) reveals that it contains no trace of $HNO_3$. Also the Tc(VII) concentration is not modified through this denitration.

b) adjustment of the pH of solution a)

The pH adjustment of solution a) is made by adding to this solution 18.8 g of tetramethylammonium hydroxide, in solid form to obtain a mixture.

This mixture is stirred until complete dissolution of the tetramethylammonium hydroxide and the pH may be adjusted more precisely to 7.32 through the addition of a few drops of a molar solution of tetramethylammonium hydroxide to obtain solution b).

c) separation of technetium

The separation of technetium from this solution b) is mad through cathodic electrodeposition of said technetium by electrolysis of solution b) in an electrolytic cell.

A diagram of the elctrolytic cell used in this example is given in FIG. 1. Said electrolytic cell 1 comprises a cathode compartment 3 and two anode compartments 5.

The cathode compartment contains a graphite cathode 9, a standard electrode 13 in saturated calomel and a magnetic stirring bar 19 for solution b). Solution b) is referenced 6 in this FIG. 1.

The anode compartments each comprise an anode 11 in platinum.

Cathode compartment 3 is separated from anode compartments 5 by cation exchange membranes 7 of "Nafion 417" type (registered trademark).

Cathode compartment 3 and anode compartments 5 are closed with lids 15 fitted with gas inlet openings 16 and gas outlet openings 17 for the elimination of the oxygen dissolved in the elextrolyte and for additional stirring during electrolysis, and with passageways for anodes 11, cathode 9 and standard electrode 13 in saturated calomel.

The solution b) obtained previously is poured into cathode compartment 3. The S/V ratio is 0.5 $cm^{-1}$, S being the surface area of the cathode and V being the volume of solution b).

Anode compartments 5 are filled with an electrolyte solution 4 compatible for electrolysis with solution b). Solution 4 is a 1 mol/l solution of nitric acid $HNO_3$.

Electrolysis was conducted by passing a direct current between the anodes and the cathode such as to maintain a constant cathode potential of −1.36 V/SHE during electrolysis, corresponding to a current density of 40 $A/m^2$.

The yield of electrodeposited technetium is calculated by measuring the decrease in activity β of solution b) in the cathode compartment, using liquid scintillation analysis.

In this example, for a pH value of solution b) in the cathode compartment of 7.32, an initial technetium-99 concentration of 2.2 mg/10 ml before electrolysis, a cathode potential $E_{cat}$ of −1.36 V/SHE, and a S/V ratio of 0.5 $cm^{-1}$, the quantity of technetium in $Tc_{met}$ and $TcO_2$, $2H_2O$ form that is electrodeposited on the cathode after 90 minutes is 2.116 mg, corresponding to a yield of 96.2%.

The quantity of technetium remaining in solution b) after electrolysis is 0.083 mg, a quantity of 0.005 g of technetium having passed into the anode compartment during electrolysis.

The results of this example are grouped under table 2 below.

EXAMPLES 2 TO 11

In these examples we studied the effect of the variation in Tc(VII) technetium concentration of solution b) at the start of electrolysis on the yield of technetium electrodeposited on the cathode; the effect of the variation in pH of solution b) at the start of electrolysis on the yield of technetium electrodeposited on the cathode; and the effect of the variation in cathode potential in relation to the standard hydrogen electrode, $E_{cat}$/SHE, on the yield of technetium electrodeposited on the cathode.

These examples are conducted in the same manner as in example 1, varying at least one of the above-mentioned parameters: the Tc(VII) concentration from 0.25 to 2.5 mg/10 ml of solution b), the pH value from 5.5 to 7.5 and the cathode potential $E_{cat}$/SHE from −0.96 to −1.36 V/SHE.

The results of examples 2 to 11 are grouped under table 2 below.

These examples show that yields of technetium electrodeposition higher than 95% can be obtained after electrolysis of denitrified solutions of technetium with technetium(VII) concentrations ranging from 250 mg/l (i.e. 2.50 mg/10 ml in the electrolytic cell), with a pH adjusted to approximately 5.5 to 7.5 and with a constant cathode potential $E_{cat}$ ranging from −1.36 to −1.16 V/SHE.

Also, the accumulation of Tc in the anode compartment in these examples did not exceed 65 mg/l.

Additional measurements to those described in these examples, of the yield of technetium electrodeposition in relation to electrolyte pH (solution b)) showed that in acid solutions with a pH of less than 1.5 to 3.5, the yield did not exceed 14 to 18% respectively for an electrolysis time of two hours.

Maximum yields were measured with pH values of between 5.5 and 7.5, more precisely between 6.0 and 7.4.

Over and above pH=8, a black precipitate appears in the electrolysis solution of the cathode compartment during electrolysis reducing the yield of electrodeposited technetium.

When the concentration of technetium in solution b) before electrolysis is higher than 5 mg/10 ml, a black precipitate also appears in the electrolysis solution of the cathode compartment during electrolysis.

EXAMPLE 12

This example illustrates the effect of the variation in the ratio between cathode surface area S and volume V of solution b)in the cathode compartment on the chemical yield of technetium electrodeposited on the cathode. Electrolysis solution b) contains 2.17 mg of technetium (VII) for a volume of 10 ml, it is adjusted to a pH of 7.37 and the potential applied to the cathode is −0.96 V/SHE. The S/V ratio is 0.25 $cm^{-1}$.

The results of this example 12 are given in table 2 below, together with the results of examples 1 to 11 previously described.

TABLE 2

| | | | | After 90 minutes' electrolysis | | | |
|---|---|---|---|---|---|---|---|
| Example n° | pH | Initial Tc (mg/10 ml) | $E_{cath}$ V/SHE | Tc on cathode (mg) | Tc remaining in solution. b) (mg) | Tc found in compatible $HNO_3$ solution (mg) | Tc yield, % electro-deposited |
| 1 | 7.32 | 2.20 | −1.36 | 2.116 | 0.083 | 0.005 | 96.2 |
| 2 | 7.32 | 2.19 | −1.16 | 1.995 | 0.192 | 0.003 | 91.2 |
| 3 | 7.35 | 2.15 | −0.96 | 1.816 | 0.333 | 0.007 | 84.5 |
| 4 | 6.46 | 2.21 | −0.96 | 1.728 | 0.482 | 0.008 | 78.2 |
| 5 | 5.39 | 2.19 | −0.96 | 1.660 | 0.528 | 0.004 | 75.8 |
| 6 | 3.95 | 2.15 | −0.96 | 1.234 | 0.916 | 0.009 | 57.4 |
| 7 | 2.96 | 2.20 | −1.36 | 0.530 | 1.670 | 0.005 | 24.1 |
| 8 | 7.32 | 5.04 | −1.36 | 4.96 | 0.080 | 0.004 | 98.4 |
| 9 | 7.30 | 1.07 | −1.36 | 1.023 | 0.041 | 0.002 | 95.6 |
| 10 | 7.32 | 0.48 | −1.36 | 0.451 | 0.029 | 0.007 | 93.9 |
| 11 | 7.36 | 0.27 | −1.36 | 0.247 | 0.024 | 0.004 | 91.7 |
| 12* | 7.37 | 2.17 | −0.96 | 1.720 | 0.449 | 0.002 | 79.3 |

*−$S_{cath}/V_{cath}$ = 0.25 $cm^{-1}$

Example 12 well illustrates the importance of the S/V ratio on the yield of technetium electrodeposited on the cathode. When S/V decreases, the electrodeposition yield also decreases.

EXAMPLE 13

This example is a study into the kinetics of technetium electrodeposition on the cathode in relation to cathode potential $E_{cat}$, measured in relation to the standard hydrogen electrode of V. The cathode potential is varied from −0.56 V/SHE to −1.36 V/SHE.

The kinetics of technetium electrodeposition is studied for a ratio S/V=0.25 $cm^{-1}$ and a ratio S/V=0.50 $cm^{-1}$.

The solution b) used in this example contains 2 mg of technetium per 10 ml of solution b), and its pH is adjusted to 7.37.

FIG. 2 illustrates the results of this example, the kinetics curve (1) for the ratio S/V=0.50 $cm^{-1}$, and the kinetics curve (2) for the ratio S/V=0.25 $cm^{-1}$. These curves represent the quantity in weight percentage of technetium electrodeposited in relation to time in minutes.

Kinetics curves (1) and (2) show that moving the cathode potential within −0.56 V/SHE to −1.36 V/SHE increases and accelerates the yield of the process. Maximum electrodeposition yield is obtained with a cathode potential of −1.36 V/SHE for an electrolysis time of 90 minutes. This yield is 96.2±3.1%.

The lowering in cathode potential to values of less than −1.36 V/SHE does not lead to increasing the electrodeposition yield, but causes detachment of the electrodeposited Tc from the cathode. Indeed when the cathode potential is reduced to values below −1.36 V/SHE, gaseous hydrogen is released on the surface of this cathode and disperses the electrodeposited Tc in the cathode compartment solution in the form of fine black particles thereby reducing the chemical yield of electrolysis.

Kinetics curves (1) and (2) clearly show that after 90 minutes' electrolysis, with a cathode potential $E_{cat}$ of −1.36 V/SHE an electrodeposition yield of technetium that is greater than 90% is obtained with a S/V ratio of 0.5 $cm^{-1}$, whereas with a S/V ratio of 0.25 $cm^{-1}$, under the same conditions, this yield remains at approximately 80%.

EXAMPLE 14

Cathodic Electrodeposition of Technetium from a Nitric Solution of Technetium using the Process of the Prior Art Described in Document U.S. Pat. No. 3,374,157

The solution used in this example is a solution containing $10^{-6}$ to $10^{-5}$ mol/l of Tc(VII), 1 mol/l of $(NH_4)_2SO_4$ and 0.1 mol/l of oxalic acid. This solution leads to the recovery of 85 to 90% of technetium on the cathode after 8 hours of electrolysis with a cathode potential of −1.36 V/SHE.

What is claimed is:

1. A process for separating technetium-99 from a nitric solution comprising the steps of:

(a) removing nitrates from the solution by contacting the solution with a compound in the presence of a catalyst, said compound being selected from the group consisting of formic acid, formaldehyde, oxalic acid, methanol, ethanol, sugar and organic compounds containing one or more groups selected from the group consisting of —OH, —COH and —COOH to obtain a denetrified solution of technetium-99 containing little or no nitrates;

(b) adjusting the pH of the denitrified solution resulting from step (a) to approximately 5.5 to 7.5; and (c) subjecting the solution resulting from step (b) to electrolysis in an electrolytic cell to thereby separate the technetium-99 by cathodic electrodeposition.

2. Process in accordance with claim 1, in which the nitrates are removed from the nitric solution using an excess of formic acid in relation to the nitrates, and the excess formic acid is removed prior to carrying out step (b).

3. Process in accordance with claim 1, in which the catalyst contains platinum.

4. Process in accordance with claim 1, in which is carried out using the base $(CH_3)_4NOH$.

5. Process in accordance with claim 4, in which the pH is adjusted to a value of between 6 and 7.4.

6. Process in accordance with claim 1, in which the pH is adjusted to a value of between 6 and 7.4.

7. Process in accordance with claim 1, in which said electrolytic cell comprises at least one anode compartment and one cathode compartment, the anode and cathode compartments being separated by a cation exchange membrane.

8. Process in accordance with claim 7, in which the solution resulting from step (b) is placed in the cathode compartment, and an electrolysis compatible solution is placed in the anode compartment.

9. Process in accordance with claim 8, in which the compatible solution is selected from the group consisting of an $HNO_3$ solution, an $HClO_4$ solution and an $H_2SO_4$ solution.

10. Process in accordance with claim 1, in which the electrolytic cell comprises a graphite cathode and a platinum anode.

11. Process in accordance with claim 1, in which cathodic electrodeposition is conducted on a cathode with a surface area S, from a volume V of solution b) the S/V ratio being approximately 0.25 to 0.50 $cm^{-1}$.

12. Process in accordance with claim 1, in which electrolysis is conducted by applying to the cathode a potential of approximately −1.16 to −1.36 V/SHE.

13. Process in accordance with claim 12, in which the nitric solution further comprises one or more elements selected from the group consisting of ruthenium-106, antimony-125, cesium-134, cesium-137, cerium-144 and europium-154.

14. Process in accordance with claim 1, in which the nitric solution is a solution derived from the reprocessing of nuclear fuel and radioactive waste.

15. Process in accordance with claim 1, in which the nitric solution further comprises one or more elements selected from the group consisting of ruthenium-106, antimony-125, cesium-134, cesium-137, cerium-144 and europium-154.

* * * * *